US007513951B2

(12) United States Patent
Miller et al.

(10) Patent No.: US 7,513,951 B2
(45) Date of Patent: Apr. 7, 2009

(54) CHEMICAL PROCESSING SYSTEM AND METHOD

(76) Inventors: Richard H. Miller, 325 N. Bentwood, Rose Hill, KS (US) 67133; Ronald E. Jones, 730 N. Milan, Conway Springs, KS (US) 67031

( * ) Notice: Subject to any disclaimer, the term of this patent is extended or adjusted under 35 U.S.C. 154(b) by 631 days.

(21) Appl. No.: 10/939,490

(22) Filed: Sep. 14, 2004

(65) Prior Publication Data

US 2006/0057299 A1 Mar. 16, 2006

(51) Int. Cl.
*B05C 3/00* (2006.01)

(52) U.S. Cl. ..... 118/423; 118/412

(58) Field of Classification Search ..... 118/712, 118/676, 423, 72–74, 304, 412, 429, 52, 118/500, 503

See application file for complete search history.

(56) References Cited

U.S. PATENT DOCUMENTS 5,143,101 A * 9/1992 Mor ..... 134/58 R
6,355,104 B1 * 3/2002 Polster ..... 118/666
6,539,957 B1 * 4/2003 Morales, Jr. ..... 134/95.2

OTHER PUBLICATIONS

MCP Chemicals—Equipment—Process Technology for Metal Finishing; The MCP System of Elctroplolishing: An Overview; 8 pages.

* cited by examiner

*Primary Examiner*—Brenda A Lamb

(57) ABSTRACT

In a system for chemically processing a metallic part, a tank, parts rotator assembly, circulation assembly, and control system are utilized to process the part. The tank includes a chemical side and a rinse side. The chemical side includes a chemical solution. The rinse side includes a sprayer to spray a rinse solution on the part. The parts rotator assembly moves relative to the tank. The circulation system circulates fluid in the tank. The control system receives signals from a sensor and modulate the system in response to the signals.

11 Claims, 6 Drawing Sheets

CHEMICAL PROCESSING SYSTEM AND METHOD

FIELD OF THE INVENTION

The present invention generally relates to metal finishing. More particularly, the present invention pertains to a device and system for chemically processing metals and a method of use.

BACKGROUND OF THE INVENTION

Chemical processing of metal parts is widely utilized in the metal fabrication industry. Chemical processing encompasses a variety of different processes. Broadly, these processes include: cleaning, de-greasing, etching, oxidizing, reducing, chemical deposition, and the like. These processes are similar in that they generally involve immersing or otherwise coating a fabricated part in a chemically reactive solution. Typically, a large batch of parts are dipped into a tank, held in the tank for some length of time and then rinsed and/or moved to another tank of some other chemically reactive solution.

A disadvantage associated with conventional chemical processing systems is that the chemical process tanks are generally designed for batching large number of parts through the process. In addition, these tanks and are typically located in a separate facility away from the fabrication process. The tanks are typically large, e.g. a 20,000 gallon capacity, and do not lend themselves to producing a flow of single work pieces.

Accordingly, it is desirable to provide a device and system for chemically processing metals and a method of use that is capable of overcoming the disadvantages described herein at least to some extent.

SUMMARY OF THE INVENTION

The foregoing needs are met, to a great extent, by the present invention, wherein in some embodiments a device and system for chemically processing metals and a method of use is provided.

An embodiment of the present invention relates to a system for chemically processing a metallic part. The system includes a tank, parts rotator assembly, circulation assembly, and control system. The a tank includes a chemical side and a rinse side. The chemical side includes a chemical solution. The rinse side includes a sprayer to spray a rinse solution on the part. The parts rotator assembly moves relative to the tank. The circulation system circulates fluid in the tank. The control system receives signals from a sensor and modulate the system in response to the signals.

Another embodiment of the present invention pertains to an apparatus for chemically processing a metallic part. The apparatus includes a means for attaching the part to a parts rotator assembly and a means for dipping the part in a chemical bath at a first end of the chemical bath. The apparatus also includes a means for advancing the part through the chemical bath and a means for raising the part over a divider in response to the part reaching a second end of the chemical bath. The apparatus further includes a means for advancing the part past the divider in response to the part being sufficiently high to clear the divider and a means for lowering the part into a rinse side in response to the part advancing sufficiently.

Yet another embodiment of the present invention relates to a method of chemically processing a metallic part. In this method, the part is attached to a parts rotator assembly and the part is dipped in a chemical bath at a first end of the chemical bath. In addition, the part is advanced through the chemical bath and the part is raised over a divider in response to the part reaching a second end of the chemical bath. Furthermore, the part is advanced past the divider in response to the part being sufficiently high to clear the divider and the part is lowered into a rinse side in response to the part advancing sufficiently.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

The present invention provides, in some embodiments, a chemical processing system and a method of chemically processing items such as manufactured parts. In an embodiment, the invention provides a chemical processing system for chemically processing various items. Advantages of certain embodiments of the chemical processing system include one or more of: processing a flow of single parts; portability; use with existing power supply; and the like. As a result of these advantages, the chemical processing system may be located adjacent to a parts manufacturing facility. In this regard, manufactured items or parts are often chemically processed to improve certain characteristics of the part. Examples of characteristics improved by chemical processing include: wear resistance; resistance to corrosion; surface hardness; coating adhesion; and the like. Depending upon the particular processing being performed, the part is subjected to one or more chemical solutions for a predetermined amount of time and at a predetermined temperature. For example, the part may be dipped in a bath of solution or the solution may be sprayed upon the part. Following each chemical bath, the part is typically rinsed to remove and collect any chemical residue. Collected chemicals are recycled or disposed of as appropriate.

Figure 1:
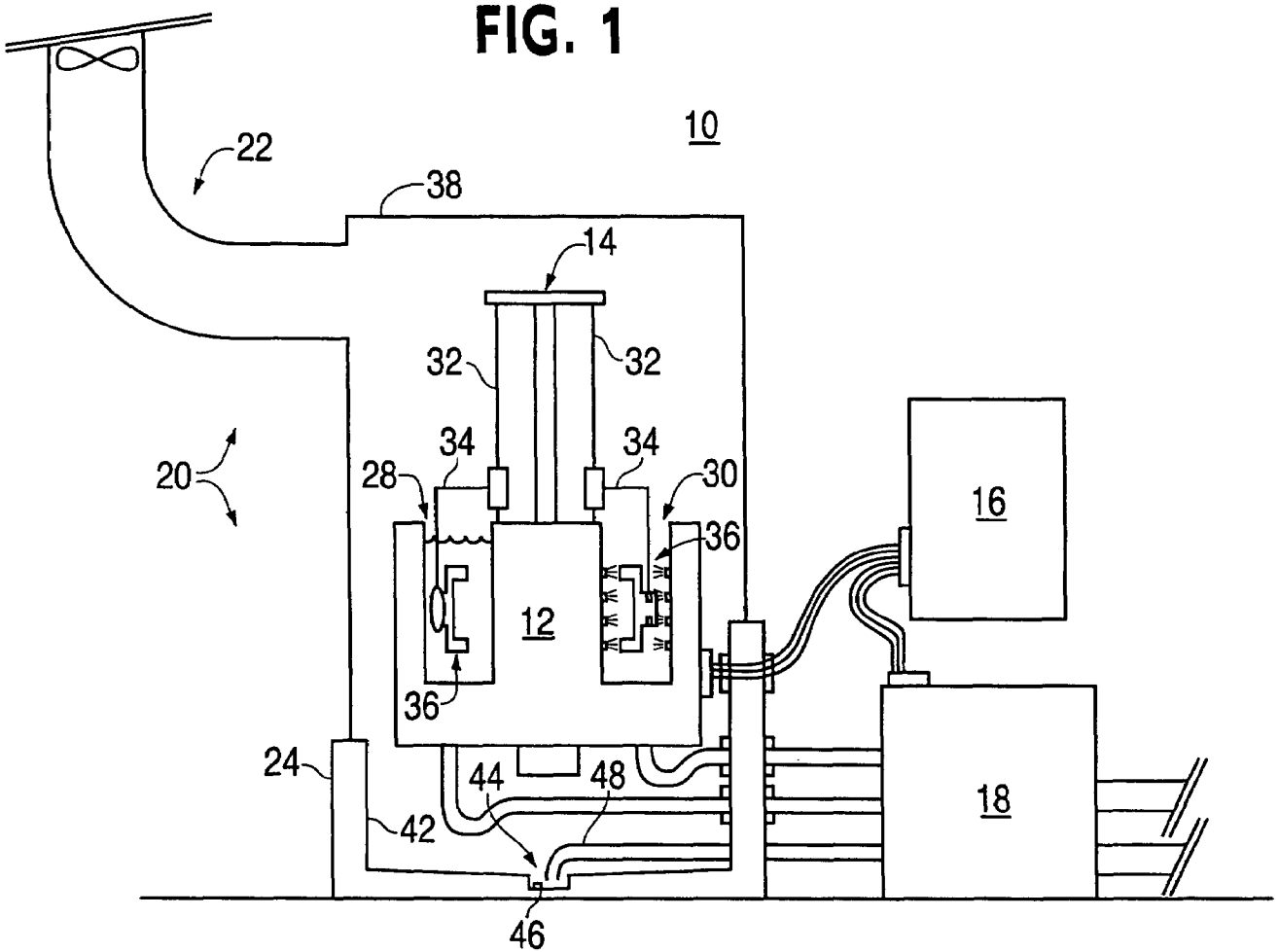
FIG. 1 is simplified view of a chemical processing system according to an embodiment of the invention.

The invention will now be described with reference to the drawing figures, in which like reference numerals refer to like parts throughout. As shown in FIG. 1, a chemical processing system 10 includes a tank 12, parts rotator assembly 14, control system 16, circulation system 18, and a containment system 20 which includes a fume control system 22, and spill control system 24.

As shown in cross section in FIG. 1, the tank 12 is generally toroid or donut shaped. The tank 12 includes one or more areas separated by tank dividers 26 (shown in FIG. 2). In a particular example, the tank 12 includes two areas: a chemical side 28 and a rinse side 30 According to various embodiments, the tank 12 includes any suitable number of areas. In general, each chemical bath area includes an associated rinse area and thus, the number of areas is typically a multiple of two such as, for example 2, 4, 6, 8 and the like. However, the tank 12 according to other embodiments includes an odd number of areas.

The parts rotator assembly 14 includes plurality of rods 32 upon which a plurality of respective part holders 34 ride. Each part holder 34 is configured to detachably secure a respective part 36. The parts rotator assembly 14 is configured to rotate relative to the tank 12 and thereby progress the parts in a single workpiece flow through the areas of the tank 12.

In general, the control system 16 is configured to control the various subsystems of the chemical processing system 10. More particularly and as described in greater detail herein, the control system 16 is configured to maintain preset temperatures travel rates, and flow rates based on inputs from a variety of sensors. Also described in greater detail herein, the circulation system 18 is modulated by the control system 16 to provide chemical and rinse solution and remove waste fluids.

The containment system 20 is configured to substantially prevent chemicals within the chemical processing system 10 from escaping into the surrounding environment. In particular, the fume control system 22 includes an envelope 38 to arrest any vapors or liquids. In addition, a vent 40 is configured to vent any gasses from the envelope 38 and maintain a lower pressure within the envelope relative to ambient pressure. Vapors removed from the envelope 38 are filtered and/or exhausted as appropriate. The spill control system 24 includes a barrier 42 and a sump 44. The barrier 42 is configured to provide sufficient volume to contain a failure of the tank 12. The sump 44 is configured to collect and dispose of a relatively minor spill. In this regard, the sump 44 is disposed at a relatively low spot of the barrier 42. The sump 44 further includes a sensor 46 to sense liquid and a sump pump intake 48 to withdraw the sensed liquid.

Figure 2:
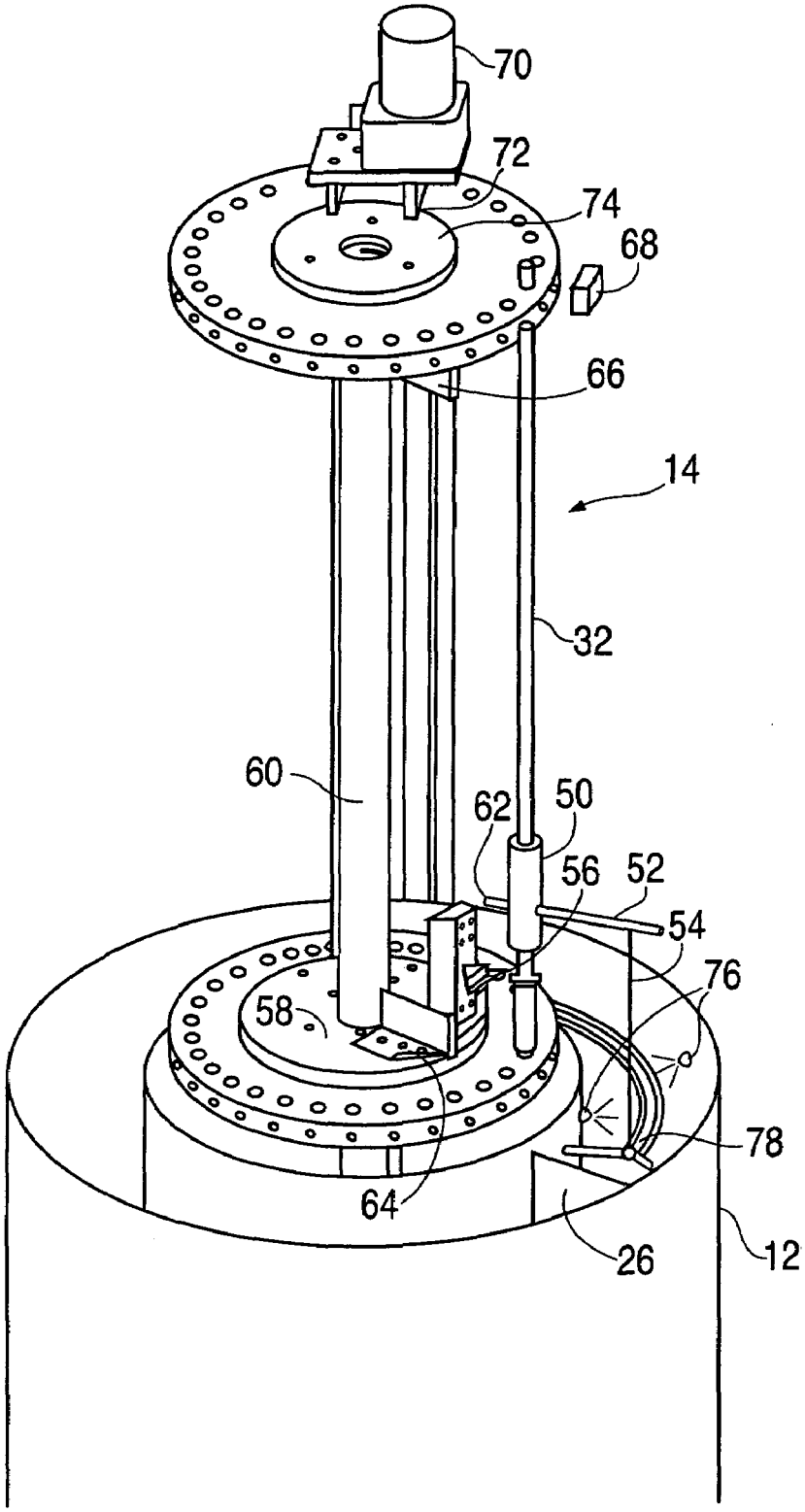
FIG. 2 is a perspective view of a tank and parts rotator assembly according to FIG. 1.

FIG. 2 is a perspective view of the tank 12 and parts rotator assembly 14. As shown in FIG. 2, the rod 32 (one rod shown for clarity) has a part holder slide 50 which is keyed to the rod 32 keeping the rod 32 clocked in position. Extending out from the part holder slide 50 is a horizontal shaft 52 which supports a vertical rod 54. The parts holder 34 attaches to the vertical rod 54 which allows the part 36 to be suspended in the tank 12. As the part 36 rotate through the chemical solution, the part eventually reaches the end of the chemical side 28 of the tank 28 and is moved to the rinse side 30. To progress the part 36 past the tank divider 26, the part 36 is lifted up by an actuator 56. This actuator 56 is disposed on a stationary plate 58. The stationary plate 58 is affixed to a center post 60. In addition, a dowel pin 62 extends inward towards the center of the parts rotator assembly 14 and pierces the parts holder slide 50. The dowel pin 62 is further disposed within a longitudinal groove of the rod 32. In this manner, the dowel pin 62 keeps the parts holder slide 50 clocked in position.

The parts rotator assembly 14 further includes a plurality of sensors 64-68 configured to sense the position of the part 36. For example, the sensor 64 is configured to sense the rod 32 is in position to be raised. In this manner and/or in response to a cycle time having elapsed, the actuator 56 is controlled to raise the part via the part holder slide 50. The sensor 66 is configured to sense the actuator 56 at a relatively high point in the travel of the actuator 56 and forward signals to the control system 16. In this manner, it is determined that the part 36 has been raised above the tank divider 26 and may advance to the rinse side 30. The sensor 68 is configured to sense when the rod 32 has advanced sufficiently to position the part 36 over the rinse side 30. In this manner, it is determined that the part 36 may be lowered into the rinse side 30 by the actuator 56. The sensor 64 is further configured to sense the part holder slide 50 is at a relative low point in its travel and forward signals to the control system 16. In this manner, the control system 16 is apprised of when to reset a cycle timer. To advance the parts rotator assembly 14, a drive motor 70 is configured to respond to signals from the control system 16. The drive motor 70 includes a pinion gear 72 configured to mesh with a pinion gear 74.

Figure 3:
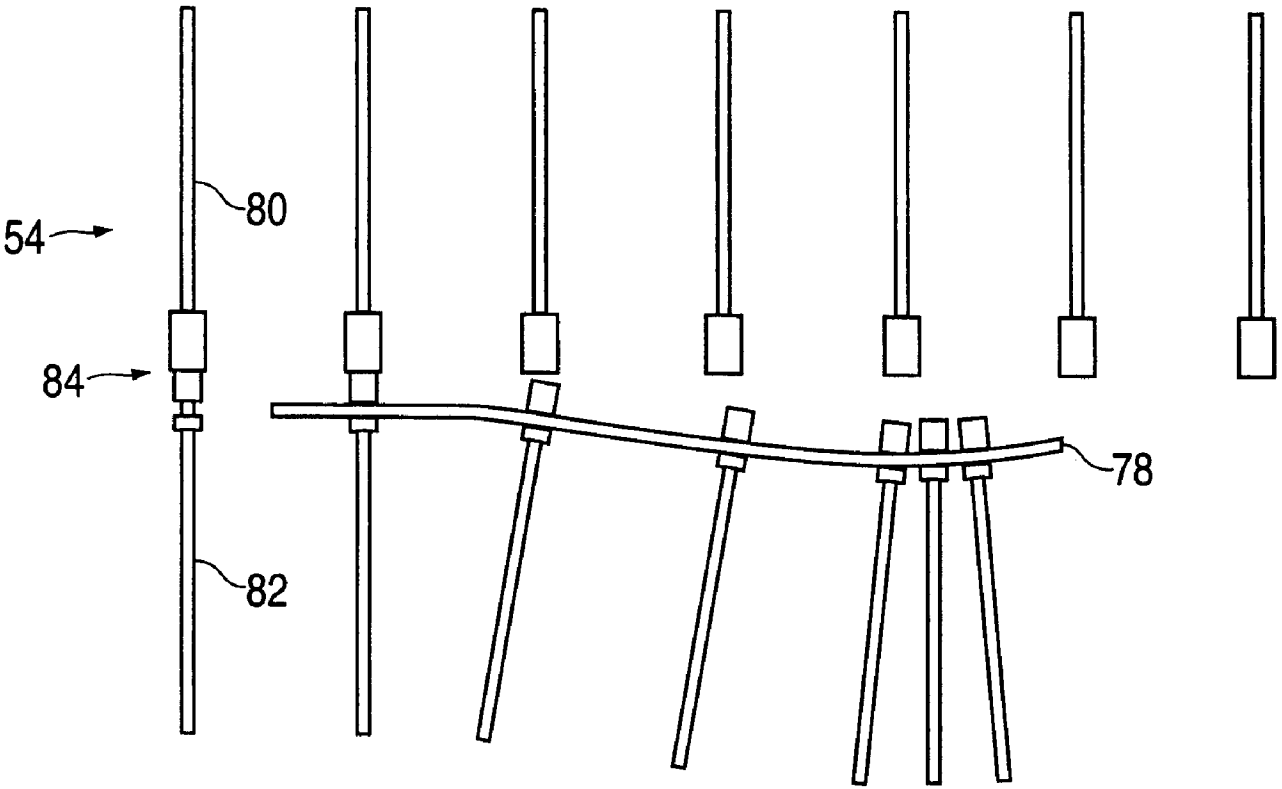
FIG. 3 is a detailed view of a rinse rack according to the system of FIG. 1.

To rinse the part 36, a plurality of spray nozzles 76 are disposed within the rinse side 30 and configured to spray rinse fluid upon the part 36. The rinse side 30 further includes a rinse rack 78. As shown in FIG. 2, the rinse rack 78 forms a channel to urge the vertical rod 54 along a proscribed path. As shown in FIG. 3, the rinse rack 78 includes a downward curve. This downward curve facilitates detaching an upper arm 80 of the vertical rod 54 from a lower arm 82 of the vertical rod 54. In this regard, the upper arm 80 and the lower arm 82 are detachably connectable via a magnetic coupling 84 or other such coupling device. To facilitate retaining the lower arm 82 on the rinse rack 78, the rinse rack 78 includes an upward curvature. In this manner, rinsed parts 36 are retained on the rinse rack 78 until being removed. It is an advantage of embodiments of the invention that the configuration of the rinse rack 78 facilitates removal of the parts 36 in a first in, first out manner.

Figure 4:
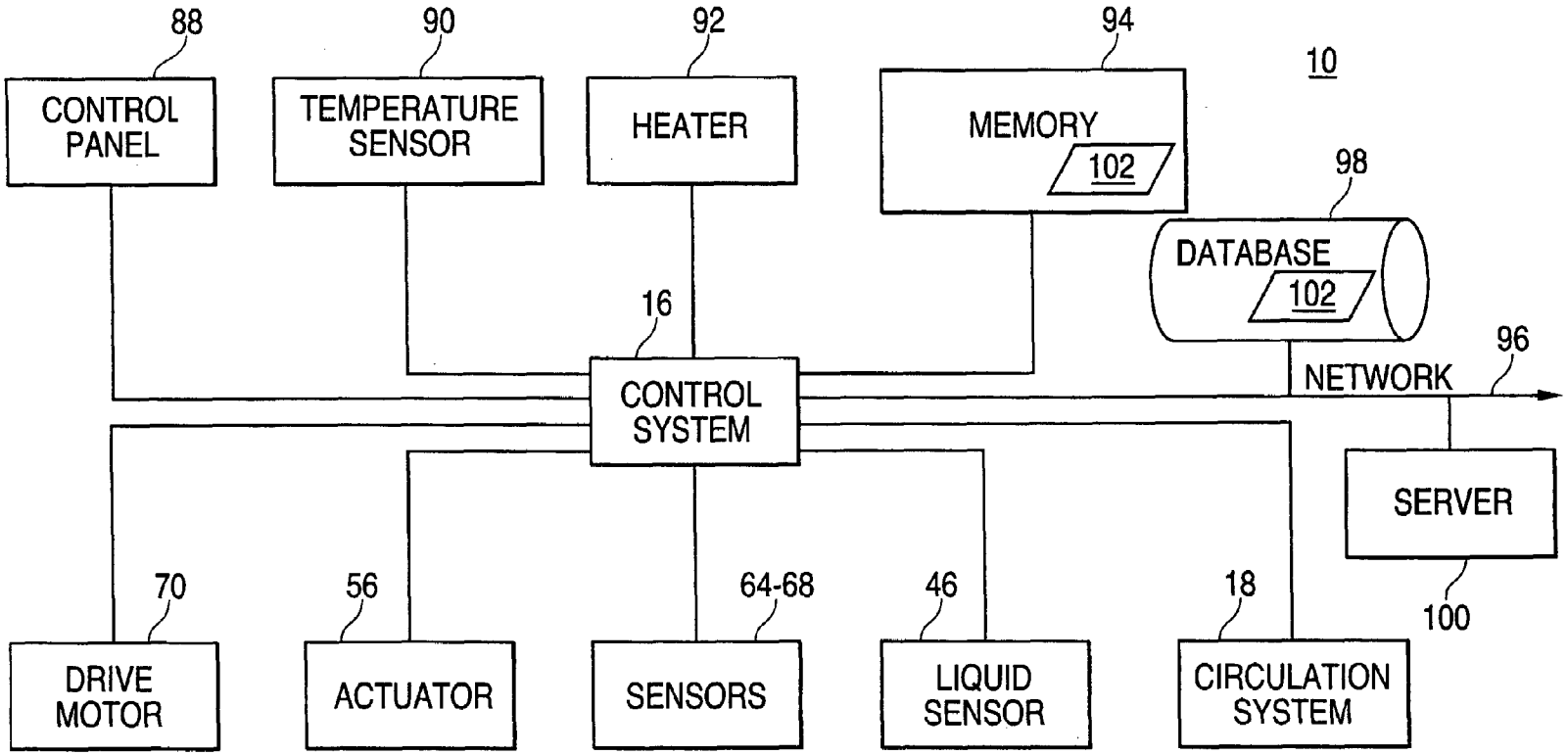
FIG. 4 is a system architecture for the chemical processing system according to the system of FIG. 1.

FIG. 4 is a system architecture for the chemical processing system 10 according to an embodiment of the invention. As shown in FIG. 4, the control system 16 is configured to modulate the actuator 56 and drive motor 70. The control system 16 is further configured to intercommunicate with the sensors 64-68, liquid sensor 46, and circulation system 18. In addition, the control system 16 is configured to intercommunicate with a control panel 88, temperature sensor 90, heater 92, and a memory 94. The memory 94 is configured to store data received from the control system 16. For example, the memory 94 may store sensor readings, dates, parts processed, and the like. The control panel 88 is configured to provide visual information to a user and accept input from the user. For example, the control panel 88 may include start and stop switches, alarms, temperature and time set points adjustments and display and the like.

Furthermore, in various embodiments of the invention, the chemical processing system 10 may include a network 96 configured to intercommunicate with the control system 16. The network 96 may include, for example, a database 98, server 100, and a multitude of other networked devices. In this regard, the network 96 may include a local area network (LAN), wide area network (WAN), wireless network, the Internet, and the like.

Moreover, the chemical processing system 10 may include at least one table 102. This table 102 may be stored to the memory 94 and/or the database 98. The table 102 may be configured to store data relating to chemically processing one or more parts. In addition, the table 102 may include data related to operational parameters of the chemical processing system 10. For example, data stored to the table 102 may include sensor readings, set temperatures, flow rates, and the like. This data may be stored to the table 102 in the form of one or more entries, for example.

Figure 5:
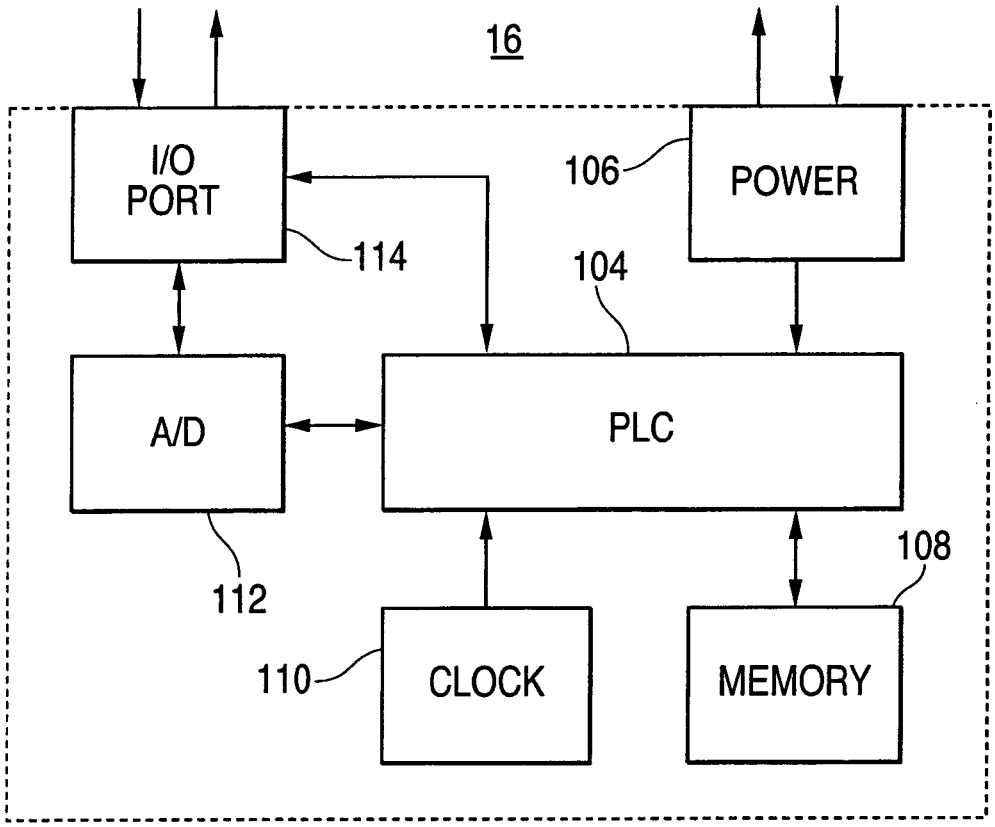
FIG. 5 is a system architecture for the control system 16 suitable for use in the system of FIG. 1.

FIG. 5 is a system architecture for the control system 16 suitable for use in the chemical processing system 10 according to FIG. 1. As shown in FIG. 5, the control system 16 includes a programmable logic controller ("PLC") 104. This PLC 104 is operably connected to a power supply 106, memory 108, clock 110, analog to digital converter (A/D) 112, and an input/output (I/O) port 114. The I/O port 114 is configured to receive signals from any suitably attached electronic device and forward these signals to the A/D 112 and/or the PLC 104. For example, the I/O port 114 may receive signals associated with temperature from the temperature sensor 90 and forward the signals to the PLC 104. If the signals are in analog format, the signals may proceed via the A/D 112. In this regard, the A/D 112 is configured to receive analog format signals and convert these signals into corresponding digital format signals. Conversely, the A/D 112 is configured to receive digital format signals from the PLC 104, convert these signals to analog format, and forward the analog signals to the I/O port 114. In this manner, electronic devices configured to receive analog signals may intercommunicate with the PLC 104.

The PLC 104 is configured to receive and transmit signals to and from the A/D 112 and/or the I/O port 114. The PLC 104 is further configured to receive time signals from the clock 110. In addition, the PLC 104 is configured to store and retrieve electronic data to and from the memory 108. Furthermore, the PLC 104 is configured to determine signals operable to modulate and thereby control the actuator 56, drive motor 70, circulation system 18, heater 92, control panel 88, and various other suitable components.

In a particular example according to an embodiment of the invention, the PLC 104 is configured to determine when it is appropriate to raise and lower the actuator 56 and advance the parts rotator assembly 14 based upon signals received from the sensors 64-68. For example, the PLC 104 may control the actuator 56 to lift the part holder slide 50 in response to signals from the sensor 64 and/or a completion of a cycle time. In this regard, the part 36 may be subjected to the chemical process for a predetermined amount of time or cycle time. This cycle time is stored to the table 102. In response to the cycle time having elapsed, it may be determined that the part 36 is to be advanced to the rinse side 30.

According to an embodiment of the invention, the PLC 104 and the containment system 20 work in conjunction to facilitate retention of the chemicals within and proper function of the chemical processing system 10. In particular, and as described herein, the chemical processing system 10 includes a variety of sensors which feed information to the PLC 104 which in turn either shuts the unit down, or sets an alarm to warn the operator a malfunction has occurred.

A first feature of the chemical processing system 10 is temperature control. The temperature of the chemical is monitored by the temperature sensor 90. Set points, high and low limits are set in the PLC 104. When the chemical processing system 10 is turned on, the PLC 104 turns the heater 92 on if the chemical temperature is below the set point. If the unit is below the set point, the PLC 104 will not allow the parts rotator assembly 14 to operate and sets an alarm. This prevents an operator from processing the parts 36 in a piece of equipment not operating at temperature specifications. If the high limit is reached indicating the temperature is over the high limit the PLC 104 will set an alarm on the control panel 88 indicating to the operator the unit is over temperature.

A second feature of the chemical processing system 10 is flow control. There is a circulation pump in the circulation system 18 which circulates the chemical solution. This serves two purposes; one, to move the chemical fluid through a heat exchanger so it can be elevated to the proper temperature, and two, to keep the chemical mixed properly. There is a flow control senor in an output line between the heat exchanger and the tank 12. If for any reason the circulating pump quits working the flow control sensor will send a signal to the PLC 104 which in turn will set an alarm on the control panel 88 the operator can see and also turn power off the heater 92 in the heater exchanger to prevent it from over heating.

A third feature of the chemical processing system 10 is the liquid level control. This prevents the level of the tank 12 from becoming too full. A level control valve is disposed in the tank 12 at a specified height the level is to be at. When the liquid level becomes low, a signal is sent to the PLC 104 from the level control valve which opens a main water valve which allows water to enter the tank 12 bringing it up to proper level. When the proper level is reached the input signal from the level control valve is stopped thus allowing the PLC 104 to shut the main water valve.

If the PLC 104 is receiving an input from the level control valve indicating chemical level is low it will also prevent the heater 92 from turning on. This prevents the heat exchanger from becoming too hot if by chance there is no chemical in the tank 12.

A fourth feature of the chemical processing system 10 is fume control. This feature is to prevent undesirable fumes from affecting the operator or other personnel in the area. This is accomplished by enclosing the entire tank 12 with Plexiglas™ and an exhaust fan duct to the chemical processing system 10. There is a door on the front of the chemical processing system 10 which allows the operator to open it when processing the parts 36. When the door is open the exhaust fan pulls air in through the door opening, across the tank 12 into the exhaust fan duct, carrying out chemical fumes. This prevents the operator from becoming in contact with undesirable fumes.

A fifth feature of the chemical processing system 10 is secondary containment. Secondary containment is advantageous in case the tank 12 develops a leak allowing chemical to spill out onto the floor. Secondary containment will keep the chemical in a confined area to be dealt with by qualified individuals to dispose of the chemical. The secondary containment of the chemical processing system 10 confers at least three advantages of conventional chemical processing systems.

A first advantage of secondary containment is over flow. If for some reason the level control valve should malfunction and allow the main water valve to remain on, the liquid level would reach a height in the tank to allow it to go over the rinse tank divider 26 which is below the top of the tank 12 sides. There is a drain in the bottom of the rinse side30 which connects to industrial waste, allowing the chemical to go directly to industrial waste.

A second advantage of secondary containment is to contain the chemical in a confined area until it can be dealt with by qualified personnel. This is accomplished by providing an area under the tank 12 which has the capacity to hold the entire contents of the tank 12. Basically the tank 12 is within a tank. A cart which holds all of the provisions to operate the chemical processing system 10 and allow it to be mobile also provides a sealed area under the tank 12 which has sides on it.

A third advantage of secondary containment is inform the operator there is a leak in the tank 12 and prevent the main water valve from opening. This is accomplished by the sump area 44 in the sealed secondary containment area under the tank 12. In this sump area 44 there is a second liquid level sensor 46. If a leak occurs the chemical will run to the sump area 44 due the angle of the floor is in the bottom the sealed secondary containment area. It is designed to allow liquid to go to the sump area 44 first. Once the liquid becomes high enough in the sump area 44 the second liquid level senor 46 sends a signal to the PLC 104 which in turn shuts off the main water valve, sets an alarm on the control panel 88 the operator can see, shuts off movement of the parts rotator assembly 14, and turns on a sump pump. The sump pump is connected to the industrial waste line which allows the spilled chemical to go directly to industrial waste eliminating a clean up by qualified personnel and keeps operators from becoming harmed from the chemical.

In the following description of FIG. 6, a method of utilizing the chemical processing system 10 is provided. According to various embodiments of the invention, the chemical processing system 10 adheres to a principle of "single piece workflow." That is, although there are several pieces in the process at any one time, a completed piece occurs every minute, for example. In conventional batch processing method, several pieces are completed at the same time every 30 minutes.

Figure 6:
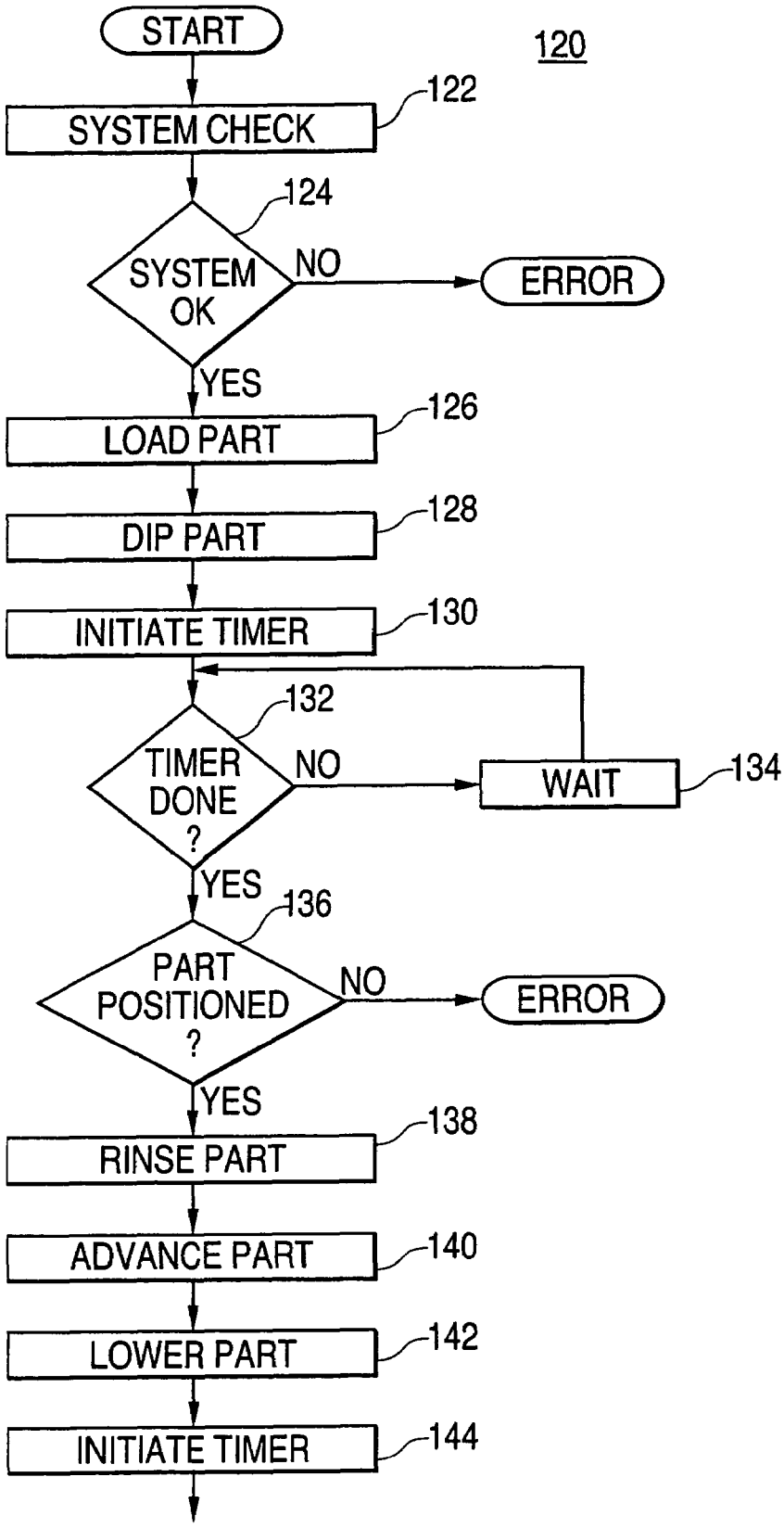
FIG. 6 is a flow diagram of a method used in the system of FIG. 1.

FIG. 6 is a flow diagram of a method 120 according to an embodiment of the invention. In the following description, the operation of one chemical processing system 10 is described. However, in other embodiments, 2 or more chemical processing systems 10 may operate. In this regard, certain chemical processes include a cleaning/degreasing, etching, and plating step with a rinse step following each chemical step. To perform such a chemical process, it may be advantageous to include three of the chemical processing systems 10. Following the cleaning/degreasing and rinse steps in a first chemical processing system 10, the part 36 is etched/deoxidized and rinsed in a second chemical processing system 10. Subsequently, the part 36 is plated and rinsed in a third chemical processing system 10.

As shown in FIG. 6, the method 120 is initiated in response to turning on the chemical processing system 10 and performing a system check at step 122. The system check encompasses any suitable number of diagnostic subroutines, calibrations, and the like. For example, at step 122, signals may be sent and received by the PLC 104 via the I/O port 114. In other examples, the control panel 88 may be powered, circulation system may be powered and controlled to initiate flow. In addition, in response to signals from the temperature sensor 90, the control system 16 may modulate the heater 92 to raise the temperature of circulating fluids.

At step 124, it is determined whether the system is functioning within a predefined normal set of parameters. If it is determined that one or more parameters are outside the predetermined normal set of parameters, it is determined that an error exists. Depending upon the error, a variety of responses may be performed. For example, if it is determined that the circulating fluid is below a predetermined minimum temperature, the control system 16 may determine the proper response is to continue heating the circulating fluid and turn on a low temperature warning light on the control panel 88. The control system 16 may further determine to inactivate the drive motor 70 to substantially prevent the parts 36 from being chemically processed in the low temperature fluids. In another example, a current measured across the drive motor 70 may exceed a predetermined high current condition and the control system 16 may determine to display an indicator of the failure and otherwise shut down the chemical processing system 10. These responses may be determined based upon a set of computer readable instructions stored to the memory 108. These instructions may be included in the table 102 or another such computer readable file. If it is determined that the chemical processing system 10 is operating within the predetermined normal set of parameters, the part 36 is loaded at step 126.

At step 126, the part 36 is loaded on to the part holder 34. In an embodiment, the part 36 is loaded automatically. However, in another embodiment, the part 36 is loaded by an operator.

At step 128, the part 36 is dipped in the chemical side 28. For example, the operator, grasping the lower arm 82 may dip the part into the chemical side 28 and attach the lower arm 82 to the upper arm 80. In other embodiments, the part 36 is dipped into the chemical side 28 automatically by an actuator such as the actuator 56. In addition, following the step 128, the part 36 is advanced through the chemical side 28.

According to various embodiments, the parts rotator assembly 14 operates in a substantially continuous manner. That is, the parts rotator assembly 14 rotates at a substantially constant rate. The rate is based on a predetermined dip time and a chemical tank distance as measured from a start area of the chemical side 28 to the end of the chemical side 28. In a particular example, if the predetermined dip time is 2 minutes and the chemical tank distance is 2 meters, then the rate is determined to be 1 meter per minute. The predetermined dip time is based on a variety of factors. These factors include one or more of the following: chemical solution manufacturers suggested dip time, part surface area, age of chemical solution, number of parts treated by solution, solution temperature, flow rate of circulating fluids, and the like.

At step 130, a cycle timer is initiated. For example, in response to a signal from a sensor, such as the sensors 64-68, the cycle timer is initiated.

At step 132, it is determined whether the cycle timer has elapsed. For example, the clock 110 is polled by the PLC 104. In response to an insufficient amount of time, the PLC 104 may wait at step 134. Following the step 134, the PLC 104 may poll the clock 110 again. In response to the cycle timer elapsing, it is determined if the part 36 is in position.

At step 136, it is determined whether the part 36 is in position to be raised by the actuator 56. For example, in response to signals from the sensor 64, the PLC 104 determines if the part holder slide 50 is disposed appropriately. If it is determined that the part 36 is not in position to be raised, an error state may result. If it is determined that the part 36 is in position then, at step 138, the part 36 is raised.

At step 138, the part 36 is raised by the actuator 56 so that the part may clear the tank divider 26 and be rinsed in the rinse side 30. For example, the PLC 104 sends a signal via the I/O port 114 to modulate the actuator 56. In response to these signals, the actuator 56 is controlled to raise the part 36. The actuator 36 is further controlled to continue raising the part 36 until the part reaches an adequate height. For example, the actuator 56 may continue to raise the part 36 until the actuator 56 has achieved a top limit. In another example, in response to signals from a sensor, such as the sensor 66, the PLC 104 determines that the part 36 has risen to an adequate height.

At step 140, the part 36 is advanced; For example, in response to signals from the sensor 66, the PLC 104 sends signals via the I/O port 114 to modulate the drive motor 70 or a motor drive controller associated with the drive motor 70. In response to the signals from the PLC 104, the drive motor 70 is controlled to advance the parts rotator assembly 14.

At step 142, the part 36 is lowered. For example, in response to signals from the sensor 68, the PLC 104 determines the part 36 has advanced sufficiently to be lowered. In response, the PLC 104 sends signals to the actuator 56 to lower the part 36 into the rinse side 30.

At step 144, the cycle timer is initiated. In this manner, it may be determined when to raise the next part 36 from the chemical side 28. Following the step 144, the part 36, suspended by the lower arm 82, is advanced along the rinse rack 78. As the rinse rack 78 slants downward, a point is eventually reached at which time the upper arm 80 is disengaged from the lower arm 82. At such point, the part 36 comes to rest suspended from the rinse rack 78 by the lower arm 82. The upper arm 80, generally continues its advance about the tank 12 due to the action of the parts rotator assembly 14. The part 36 may remain suspended from the rinse rack 78 until such time as it is removed automatically or by the operator. As described herein, it is an advantage of the present invention that the part 36 is processed in a single piece workflow manner. As each process is performed, an opportunity exists to evaluate the part 36. In response to a detected error in the processing of the part 36, the flow of parts may be halted until such time as the cause of the problem is identified and corrected. Following the step 144, the part 36 may be dried and/or subjected to further chemical processing as desired.

It is to be noted that the steps for the method 120 need not proceed in the order presented, but rather, may proceed in any suitable order.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A system for chemically processing a metallic part, the system comprising:

a tank including a chemical side and a rinse side, the chemical side including a chemical solution, the rinse side including a sprayer to spray a rinse solution on the part;

a parts rotator assembly to move relative to the tank;

a lower arm configured to hold the part;

an upper arm disposed upon the parts rotator assembly, the upper arm and the lower arm being detachably connected by a magnetic latch;

a circulation system to circulate fluid in the tank; and a control system to receive signals from a sensor and modulate the system in response to the signals.

2. The system according to claim 1, further comprising:

a containment system to retain chemical within the system.

3. The system according to claim 2, wherein the containment system comprises:

a fume control system to retain chemical fumes.

4. The system according to claim 2, wherein the containment system comprises:

a spill control system to retain chemical solution.

5. The system according to claim 1, further comprising:

a rinse rack disposed within the rinse side and configured to detach the lower arm from the upper arm.

6. An apparatus for chemically processing a metallic part, the apparatus comprising:

means for attaching the part to a parts rotator assembly;

means for forming a detachable connection between an upper arm and a lower arm to attach the part to the parts rotator assembly, the upper arm being disposed upon the parts rotator assembly, the lower arm being configured to hold the part;

means for dipping the part in a chemical bath at a first end of the chemical bath;

means for advancing the part through the chemical bath;

means for raising the part over a divider in response to the part reaching a second end of the chemical bath;

means for advancing the part past the divider in response to the part being sufficiently high to clear the divider; and means for lowering the part into a rinse side in response to the part advancing sufficiently.

7. The apparatus according to claim 6, further comprising:

means for sensing the part has reached the second end.

8. The apparatus according to claim 6, further comprising:

means for sensing the part has advanced past the divider.

9. The apparatus according to claim 6, further comprising:

means for sensing the part has been lowered into the rinse side.

10. The apparatus according to claim 6, further comprising:

means for detaching the detachable connection in response to the part advancing along a rack disposed within the rinse side.

11. The apparatus according to claim 6, further comprising:

means for rinsing the part in response to the part being lowered into the rinse side.

* * * * *